US006109423A

United States Patent [19]

Moriyasu et al.

[11] Patent Number: 6,109,423

[45] Date of Patent: Aug. 29, 2000

[54] FEED STROKE CHANGING DEVICE FOR TRANSFER FEEDER

[75] Inventors: Takashi Moriyasu; Kenji Nishida; Shigekazu Noda; Kiichirou Kawamoto, all of Ishikawa-ken, Japan

[73] Assignee: Komatsu Ltd., Tokyo, Japan

[21] Appl. No.: 09/077,631

[22] PCT Filed: Dec. 6, 1996

[86] PCT No.: PCT/JP96/03595

§ 371 Date: May 28, 1998

§ 102(e) Date: May 28, 1998

[87] PCT Pub. No.: WO97/20648

PCT Pub. Date: Jun. 12, 1997

[30] Foreign Application Priority Data

Dec. 6, 1995 [JP] Japan ..... 7-317860
Feb. 27, 1996 [JP] Japan ..... 8-039712

[51] Int. Cl.[7] ..... B65G 25/04

[52] U.S. Cl. ..... 198/468.4; 198/468.01

[58] Field of Search ..... 198/468.01, 468.4, 198/468.3, 468.6, 465.1, 465.4

[56] References Cited

U.S. PATENT DOCUMENTS 4,995,505 2/1991 Takahashi et al. ..... 198/468.4
5,257,899 11/1993 Asakura et al. ..... 198/468.4

FOREIGN PATENT DOCUMENTS 61-115633 6/1986 Japan .
64-5719 1/1989 Japan .
1-68129 5/1989 Japan .

*Primary Examiner*—James R. Bidwell
*Attorney, Agent, or Firm*—Frishauf, Holtz, Goodman, Langer & Chick, P.C.

[57] ABSTRACT

For a transfer feeder for use in a transfer press having a plurality of work stations in a press machine body, having a plurality of cross bars arranged as spaced apart from one another in a feed direction and operative to move two-dimensionally by a feed means and a lift means, and an attractive means carried by each of the cross bars for attractively holding a workpiece and movable therewith for transferring the workpiece into and from one of the work stations to another sequentially, a feed stroke varying apparatus is disclosed which comprises: a pair of lift beams adapted to be raised and lowered by the lift means; a plurality of cross bar carriers carried as spaced apart from one another by the pair of lift beams in the feed direction and each constructed of a principal carrier and a subsidiary carrier; a coupling means for interconnecting such principal carriers; a link member for connecting to the feed means one of the principal carriers which is located at a most upstream side thereof; a feed stroke changing means arranged between a said principal carrier and a said subsidiary carrier for changing a distance relative between them to alter a stroke of feed performed by the cross bars; and a control means for controlling an operation of the feed stroke changing means, each of the cross bars being detachably bridged across a pair of the subsidiary carriers opposed to each other, the feed means being adapted to reciprocate the cross bars in the feed direction, the feed stroke changing means being adapted to alter the feed stroke of the cross bars.

2 Claims, 12 Drawing Sheets

FEED STROKE CHANGING DEVICE FOR TRANSFER FEEDER

TECHNICAL FIELD

The present invention relates to a feed stroke varying apparatus for a transfer feeder for use in a transfer press in which a vacuum (suction) type work carrier system is employed.

BACKGROUND ART

A conventional transfer press having a plurality of work stations in a press machine main body is equipped with a transfer feeder and is constructed to transfer a workpiece sequentially into the successive work stations therewith.

Such a transfer feeder typically includes a pair of transfer bars which are arranged in parallel so as to extend in a feed direction. A plurality of cross bars each having a work suction means which is adapted to hold the workpiece are bridged transversely across the transfer bars to lie equidistantly spaced apart from one another in the feed direction. In operation, the transfer bars are driven two dimensionally both in the feed direction and in the lift direction to allow the workpiece to be transferred into and from one of the work stations into another in sequence.

In a transfer feeder as described above, a feed cam is rotated by a power taken from the press main body to cause a feed lever to be swung so that the above mentioned transfer bars which are mechanically coupled to the feed lever may be driven in the feed direction. With such a construction adopted, the transfer feeder of this type provides a feed stroke that is definitely determined by a particular profile of the feed cam, which therefore cannot be changed without exchanging the feed cam, and hence has been found to be inconvenient.

In order to take into account such an inconvenience, there has been proposed, e. g., in Japanese Unexamined Patent Publication No. Sho 61-115633 or Japanese Unexamined Utility Model Publication No. Sho 64-5719, a workpiece transfer apparatus that is designed to allow the feed stroke of a cross bar to be altered.

A workpiece transfer apparatus as described in these publications includes a pair of feed bars (which correspond to the transfer bars mentioned) extending in the feed direction each of which is provided with a slide member that is slidable in the feed direction. A cross bar is there bridged transversely across a pair of such slide members which are juxtaposed with each other to provide a feed stroke that can be rendered variable when they are displaced in the feed direction by a cylinder drive unit to allow them to move relative to the feed bars.

A workpiece transfer apparatus as proposed in these publications has, however, been found to be yet inconvenient because of the construction in which a guide means for guiding the feed bars in the feed direction and a guide means for guiding the slide members slidably need to be arranged to be vertically separate. This requires the structure for the both placed to be greater in height to the extent that the field of view and the visibility for the inside of the press machine may substantially be lost by the slide members, the cylinder drive unit and so forth.

An increase in height of the press machine body also results in an increased backlash or looseness thereof in the vertical direction, which tends to cause the cross bars to be vibrated, bringing about an accidental fall of the work from the work suction means and further a failure in or an incorrectness of feed.

A transfer feeder must also be used wherein the path in which a workpiece is transferred (path line) can in height be varied in several levels depending on the sizes and shapes of particular workpieces. If the path line is to be altered in the transfer feeder, it, too, has been found to be defective because of the development of an error in feed stroke and the inability to suck a proper position of a workpiece with the suction means for reasons as mentioned below.

Specifically, the structure in which a feed lever and a cross bar carrier are coupled together by a linkage having a given length causes a change in height of the cross bar carrier with the feed lever halted to result in a circular motion of the point at which the link member and the cross bar carrier are pivotally connected together about the point at which the link member and the feed lever are pivotally connected together.

A change in height of the path line may, therefore, cause the cross bar carrier to be displaced in the feed direction, bringing about inconveniences represented by the development of an error in feed stroke. Consequently, the suction means becomes unable to attract and thereby to hold a workpiece as properly positioned, which thus tends to be incorrectly fed in the path line or cannot be transferred into a work station accurately at a given location.

In an attempt to resolve such problems, a corrective apparatus for a transfer feeder has been proposed in which a height adjustment means is provided at a site where the link member and the cross bar carrier are coupled together so that if the path line is varied in height the pivotal point at which the link member and the cross bar carrier are connected together may be vertically adjusted in position by the height adjustment means, thus that there may be no error in feed stroke.

The corrective apparatus proposed has yet been found to be disadvantageous, however, in that it involves a substantial increase in cost arising from the need for a height adjustment motor means and it is also inconvenient for the requirement of a space for accepting the height adjustment means where the link member and the cross bar carrier are coupled together.

It is accordingly an object of the present invention to eliminate these disadvantages in the prior art and to provide a variable feed stroke feeder apparatus for a transfer feeder which permits the feed stroke to be altered without difficulty and assures a good visibility in the press machine body, yet without permitting a change in height of the path line to develop an error in feed stroke.

SUMMARY OF THE INVENTION

In order to achieve the above mentioned object, there is provided in accordance with the present invention in a certain aspect thereof a feed stroke varying apparatus for a transfer feeder for use in a transfer press having a plurality of work stations in a press machine body, the transfer feeder having a plurality of cross bars arranged as spaced apart from one another in a feed direction and operative to move two-dimensionally by a feed means and a lift means, and an attractive means carried by each of the cross bars for attractively holding a workpiece and movable therewith for transferring the workpiece into and from one of the work stations to another sequentially, the feed stroke varying apparatus comprising: a pair of lift beams adapted to be raised and lowered by the said lift means; a plurality of cross bar carriers carried as spaced apart from one another by the said pair of lift beams in the feed direction and each constructed of a principal carrier and a subsidiary carrier; a coupling means for interconnecting such principal carriers; a link member for connecting to the said feed means one of said principal carriers which is located at a most upstream side thereof; a feed stroke changing means arranged between a said principal carrier and a said subsidiary carrier for changing a distance relative between them to alter a stroke of feed performed by the said cross bars; and a control means for controlling an operation of the said feed stroke changing means, wherein each of the said cross bars is detachably bridged across a pair of the said subsidiary carriers opposed to each other; the said feed means is adapted to reciprocate the said cross bars in the feed direction, and the said feed stroke changing means is adapted to alter the feed stroke of the said cross bars.

According to the construction described above, it can be noted and should be understood that changing the relative distance between the principal carrier and the subsidiary carrier by the use of a feed stroke changing means enables the feed stroke of the cross bars to be altered as desired and hence, even if the work stations are not spaced equidistantly, enables a workpiece to be transferred into them sequentially and in succession without any trouble.

It can also be noted and should also be understood that changing the feed stroke of the cross bars during a feed operation enables a workpiece to be transferred without the workpiece, the workpiece attracting means or the cross bars interfering with a die or a slide, thereby reducing an area of possible interference and hence increases the degree of freedom of designing a series of dies. Also, since the structure of the die itself can be simplified, there results a substantial saving in the cost of press dies.

In the construction described, it is desirable that the said feed stroke changing means comprise a servo cylinder assembly having a first end connected to the said principal carrier and a second end connected to the said subsidiary carrier.

It is also desirable that the said feed stroke changing means comprise: a rack having one end connected to one of the said principal carrier and the said subsidiary carrier, and a pinion in mesh with the said rack and adapted to be driven by a rotational drive source mounted to the other of the said principal carrier and the said subsidiary carrier.

It can be seen and should be appreciated that the construction just mentioned above enables the feed stroke to be readily and smoothly altered even in the course of a feed operation and hence to be changed with precision.

In the construction first described above, it is desirable that the said principal carrier and the said subsidiary carrier are suspended from a lower side of said lift beam so as to be capable of reciprocating.

It can be noted and should be understood that the construction just described above enables a single guide rail or a single set of guide rails to be used for both the principal and subsidiary carriers, and accordingly can lower in height a guide rail assembly as in the prior art which is to be arranged in two levels, while substantially improving the field of view or visibility in a vertical direction of the lift beams.

An improvement in the field of view and visibility for the inside of a press machine main body that results can be seen and should be noted to enable the observation of a press-forming operation to prevent a defective product from occurring. Also, a reduction in height of the system and further a reduced backlash or looseness of components in the vertical direction minimize any vibrations which may be created in the cross bars, thus eliminating an inconvenience as met in the prior art, a cause resulting in the accidental fall of a work from the work attracting means or the occurrence of a failed or incorrect feed.

Further in the construction first mentioned above, it is desirable that the control means be responsive to an error in feed stroke resulting from a change in transfer press path line as caused by a change in height of the cross bars and be operative to act to expand or extend and contract or retract the said feed stroke changing means so as to correct such an error.

According to the construction just described above, it can be seen and should be understood that a change in the transfer press path line does not allow an error to be caused in the feed stroke and hence prevents a workpiece from being held as mis-positioned to the work holder, from being incorrectly fed or from being transferred as mis-positioned into a work station, caused by the inability to attract a proper position of a workpiece with the workpiece attracting means. In addition to eliminating these and other inconveniences as have been met in the prior art, the specific construction described makes it unnecessary to introduce a height adjustment means as has been required heretofore to correct an error in the feed stroke and thus provides a substantial saving in both the cost and space entailed in the transfer press.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

DETAILED DESCRIPTION

Hereinafter, suitable embodiments of the present invention with respect to a feed stroke varying apparatus for a transfer feeder are set forth with reference to the accompanying drawings hereof.

Figure 1:
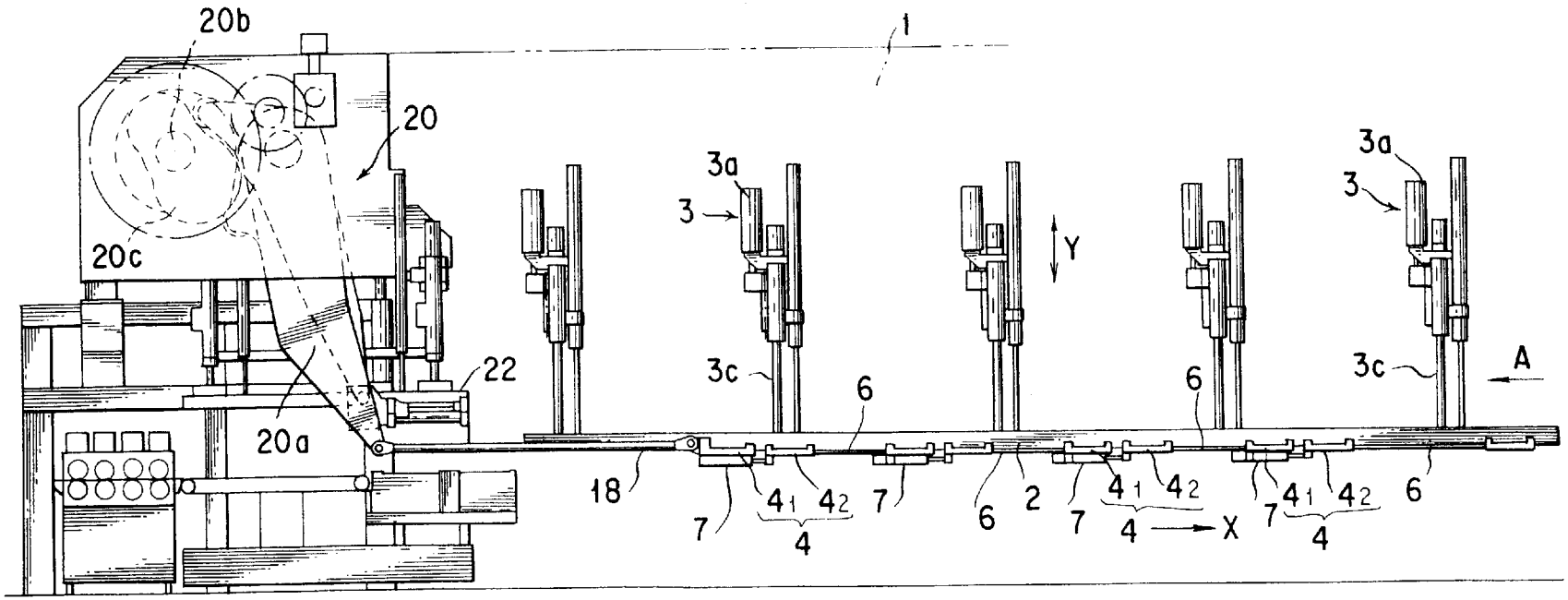
FIG. 1 is a front view that shows a transfer press in which a first embodiment of the variable feed stroke feeder apparatus for a transfer feeder is provided according to the present invention.
Figure 2:
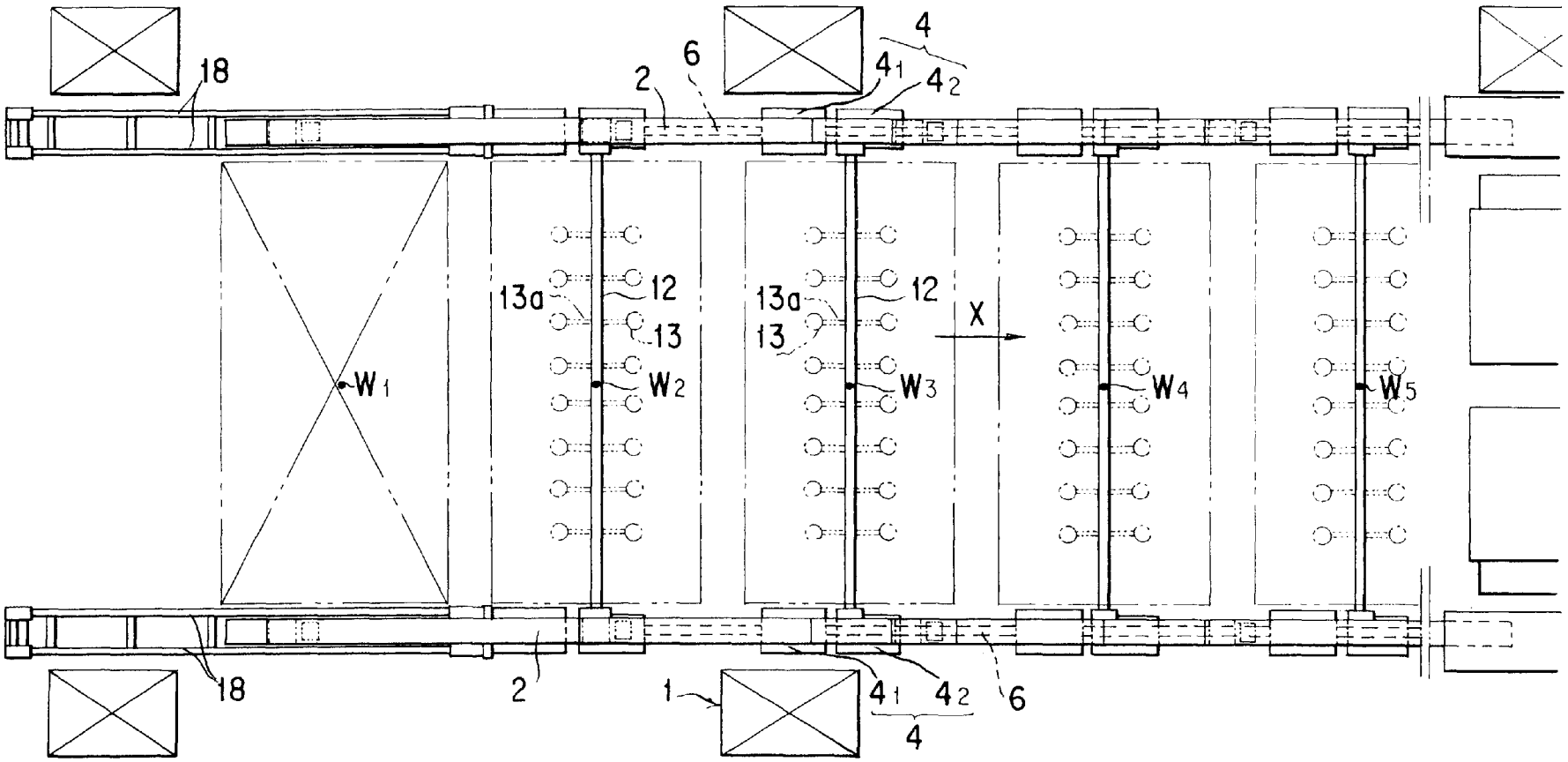
FIG. 2 is a top plan view that shows a transfer feeder incorporating that the first embodiment of the present invention.
Figure 3:
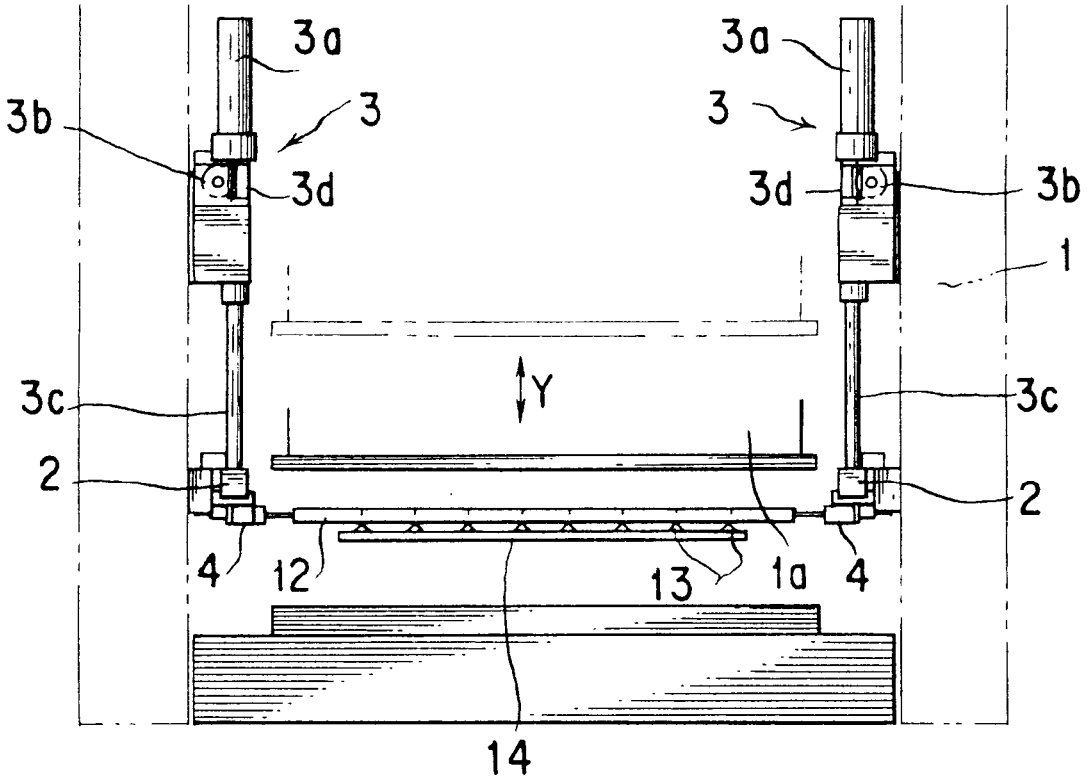
FIG. 3 is a side elevational view taken as viewed in the direction of the arrow A in FIG. 1.
Figure 4:
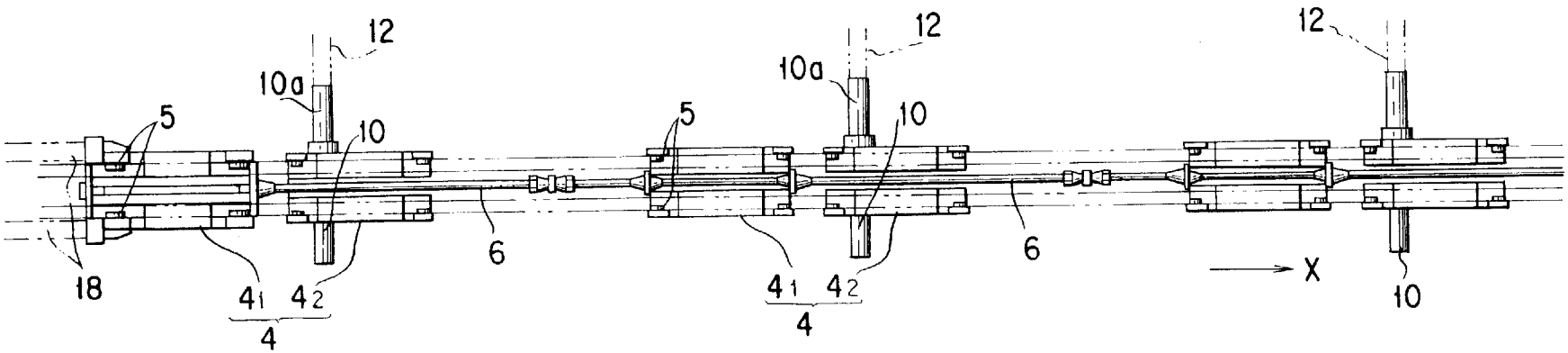
FIG. 4 is a bottom plan view that shows cross bar carriers illustrating the first embodiment of the present invention.
Figure 5:
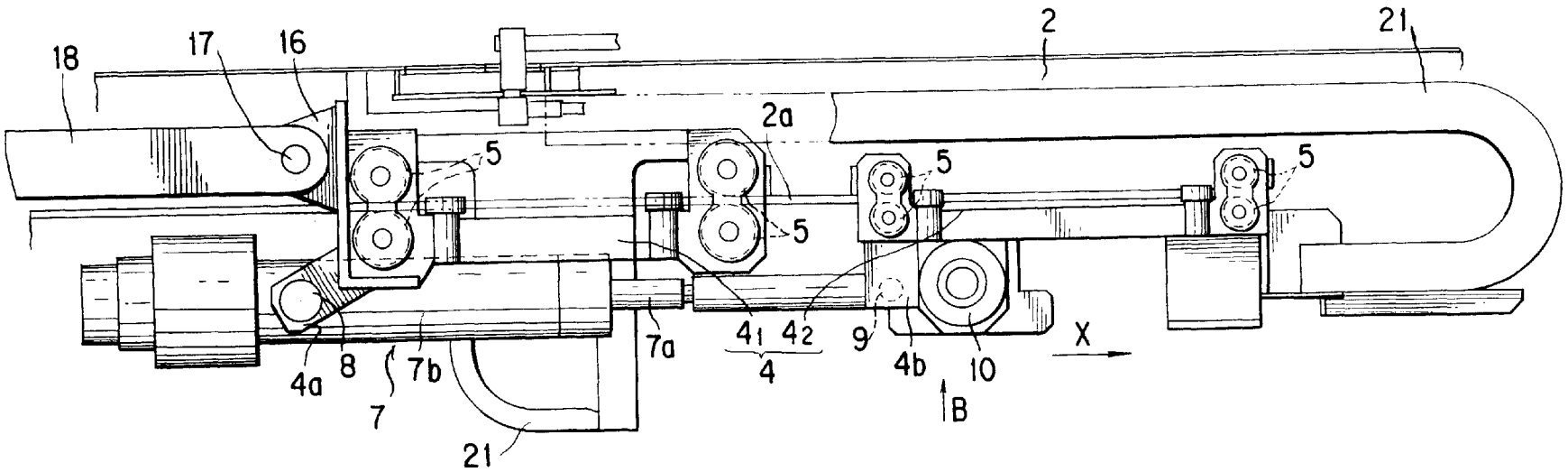
FIG. 5 is an enlarged front view that shows a cross bar carrier that is located at the most upstream side of the cross bar carrier arrangement, illustrating the first embodiment of the present invention.
Figure 6:
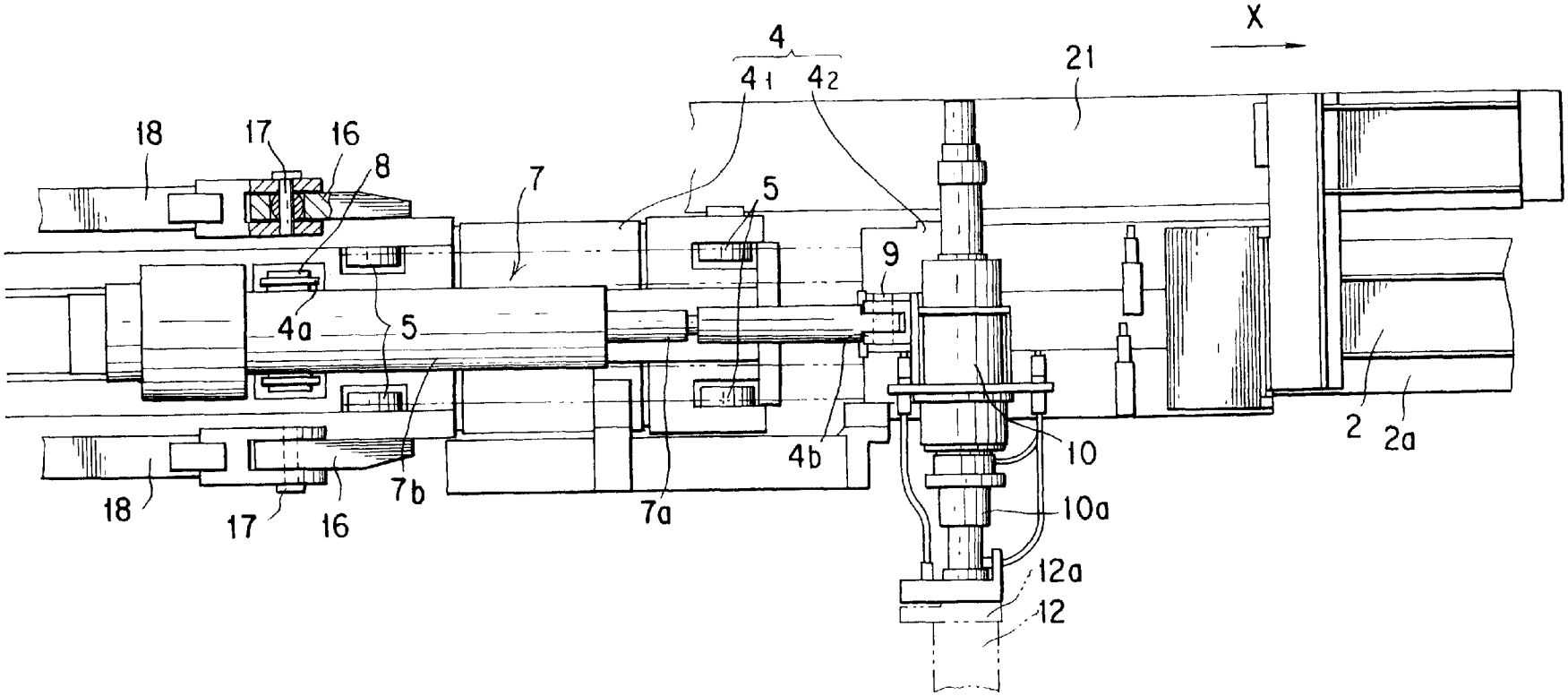
FIG. 6 is a side elevational view taken as viewed from the direction of the arrow B in FIG. 5.
Figure 7:
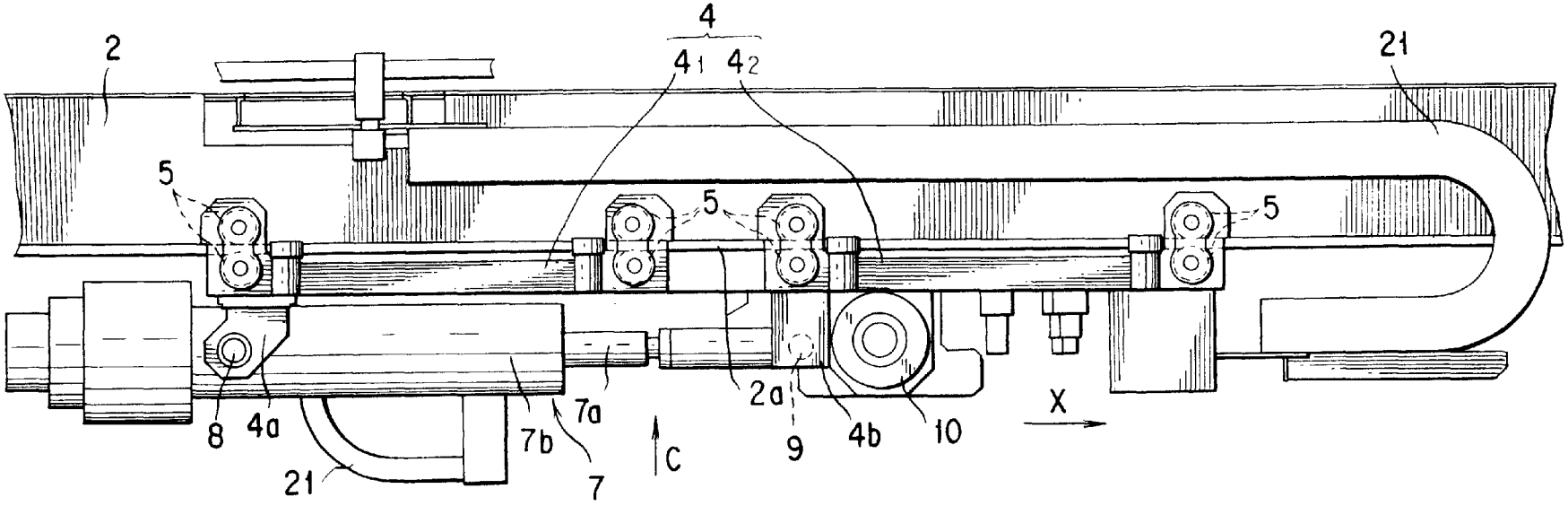
FIG. 7 is an enlarged front view that shows a cross bar carrier which is located at a downstream or middlestream of the cross bar carrier arrangement, illustrating the first embodiment of the present invention.
Figure 8:
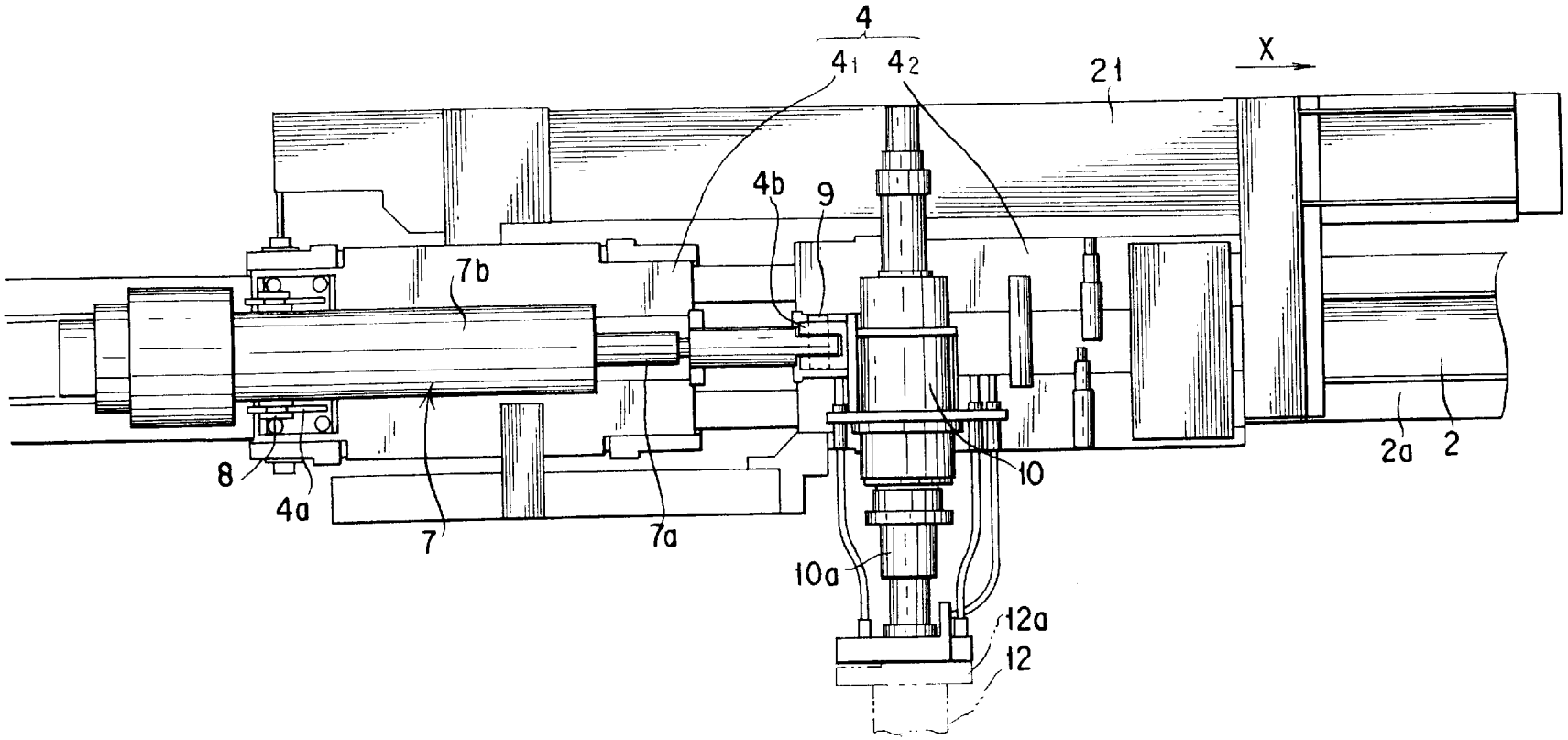
FIG. 8 is a side elevational view taken as viewed from the direction of the arrow C in FIG. 7.
Figure 9A:
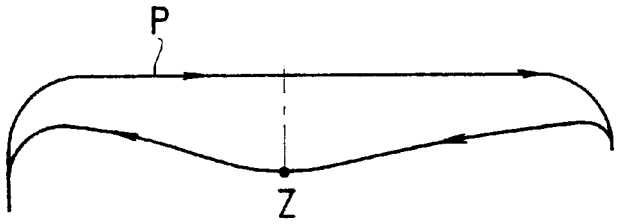
FIGS. 9A, 9B, 9C and 9D are each an explanatory view that illustrates the operation of the first embodiment of the present invention.

FIG. 1 is a front view that shows a transfer feeder in which a suction (vacuum) type workpiece attracting and holding system is employed; FIG. 2 is top plan view thereof; FIG. 3 is a side elevational view taken as viewed in the direction of the arrow A in FIG. 1; FIG. 4 is a bottom plan view that shows cross bar carriers upon which a first embodiment of the present invention relating to a feed stroke varying apparatus for a transfer feeder is practiced in accordance with the present invention; FIG. 5 is an enlarged front view that shows a cross bar carrier; FIG. 6 is a side elevational view taken as viewed from the direction of the arrow B in FIG. 5; FIG. 7 is an enlarged front view that shows a cross bar carrier; FIG. 8 is a side elevational view taken as viewed from the direction of the arrow C in FIG. 7; FIGS. 9A, 9B, 9C and 9D; and FIGS. 10A and 10B are each a functional explanatory view that illustrates an operation.

The transfer feeder shown in FIGS. 1 through 3 is equipped in the press machine main body of a transfer press and has a pair of lift beams 2 arranged in a feed direction thereof (i. e. an X-axis direction). The lift beams 2 are capable of being displaced vertically in a lift direction thereof (i. e. a Y-axis direction) by a plurality of lift means 3 which are arranged as spaced apart from one another in the feed (X-axis) direction.

The lift means 3 includes a lift motor 3*a* (a servo motor) and has a pinion 3*b* rotated both normally and reversely by the lift motor 3*a*.

Each of such pinions 3*b* is in mesh with a rack 3*d* formed on a lifting rod 3*c* so that a rotation of the pinions 3*b* may cause the respective lifting rods 3*c* at the same time to be moved vertically in the lift (Y-axis) direction. The lifting rods 3*c* have their respective lower ends connected to either of the two lift beams 2 so that a vertical movement of each of the lifting rods 3*c* may cause the lift beams 2 both ahead and behind thereof at the same time to be moved vertically.

Each of the lift beams 2 has a plurality of cross bar carriers 4 arranged as spaced apart from one another on the feed (X-axis) direction.

As shown in FIG. 4, each of the cross bar carriers is divided into a principal carrier $\mathbf{4}_1$ and a subsidiary carrier $\mathbf{4}_2$ and has two ends on which are supported a pair of rollers 5 as rotatable, respectively. Positioned between these rollers 5 are a pair of guide rails 2*a* which project at a pair of lower sides of the lift beams 2, respectively. The principal carriers $\mathbf{4}_1$ and the subsidiary carrier $\mathbf{4}_2$ are suspended downwards from the lift beams 2 so as to be displaceable in the feed (X-axis) direction along the guide rails 2*a*, respectively.

As shown in FIG. 4, adjacent principal carriers $\mathbf{4}_1$ are connected together by a pair of connecting rods 6 beneath the lift beams 2 and are capable of being reciprocated at the same time by a feed means 20, which will be described later, in the feed (X-axis) direction.

A support bracket 4*a* is mounted to the lower surface of each of the principal carriers $\mathbf{4}_1$ at its upstream side as projecting therefrom and has the base end side of a feed stroke changing means 7 pivotally connected thereto by means of a pin 8.

The feed stroke changing means 7, for example, is constituted by a servo cylinder assembly 7*b* wherein the forward end of a piston rod 7*a* projecting from the forward end of the servo cylinder assembly 7*b* into the subsidiary carrier ($\mathbf{4}_2$) side is pivotally connected by means of a pin 9 to a bracket 4*b* which is mounted to the lower surface of each of the subsidiary carriers $\mathbf{4}_2$ at its upstream side as projecting therefrom. In this fashion, the principal carrier $\mathbf{4}_1$ and the subsidiary carrier $\mathbf{4}_2$ in each of the cross bar carriers 4 are coupled together by the feed stroke changing means 7 according to the embodiment here shown.

There is also mounted a tilt means 10 to the lower surface of each of the subsidiary carriers $\mathbf{4}_2$ as extending in a direction orthogonal to the feed (X-axis) direction.

A rotary shaft 10*a* of each of the tilt means 10 is arranged to project into the sides of the subsidiary carriers $\mathbf{4}_2$ which are juxtaposed with each other, and the two ends of a cross bar 12 is removably supported on the rotary shaft 10*a* of the tilt means 10 on the pair of those mutually juxtaposed subsidiary carriers $\mathbf{4}_2$.

The cross bar 12 may be constituted by an elongate angular steel tube and a plurality of such tubes may as shown in FIG. 2 be arranged as spaced apart from one another in the feed (X-axis) direction, permitting connecting members 12*a* mounted to their respective two ends to be coupled to the respective two ends of the rotary axes of the tilt means 10. Each of the cross bars 12 has a plurality of work attracting means 13, each of which may be constituted by a suction cup, detachably mounted thereto via a like plurality of support arms 13*a*, respectively, so that a workpiece 14 may be attracted by such a work attracting means 13 in each of the work stations W1, W2, W3, . . . .

On the other hand, the principal carrier $\mathbf{4}_1$ of the one of cross bar carriers 4 which is located at a most upstream side thereof has mounted to its end surfaces a pair of connecting pieces 16 as projecting therefrom as shown in FIGS. 5 and 6, and to each of which one end side of a link member 18 is pivotally connected via a pin 17.

The link member 18 is positioned over the two opposite sides of the lift beams 2 and has the other end side coupled to the lower end of a feed lever 20*a* of the feed means 20 which is disposed at an upper upstream side of the press machine main body 1.

The feed means 20 has a cam shaft 20*b* which is adapted to be rotated by a power as taken from a slide drive mechanism (not shown). A feed cam 20*c* secured to the cam shaft 20*b* allows the lower end of the feed lever 20*a* to be swung in the feed (X-axis) direction about the support portion for its upper part as a center, thereby causing the cross bar carriers 4 at the same time to be reciprocated in the feed (X-axis) direction via the link member 18.

It should be noted that a piping arrangement (not shown) for supplying power in the form of a pressurized hydraulic or pneumatic fluid into the feed stroke changing means 7, the tilt means 10 and other parts as mounted to the cross bar carriers 4 and electric cables (not shown) for transmitting signals from various sensing means as mounted to the cross bar carriers 4 as well as for supplying electric power may be received in a cable bearer 21 as shown in FIGS. 5 though 8. Also, the lift means 3 and the feed stroke changing means 7 are adapted to be controlled by a control means.

The operation of the transfer feeder constituted above is explained as follows.

A workpiece 14 in the form of a plate to be press-formed is introduced from an upstream side (left side in FIG. 1) of the press machine main body 1 and transferred by a work transfer means 22 into a first work station W1.

Next, power taken from the slide drive mechanism of the press main body 1 is used to rotate the feed cam 20*c*, causing the feed lever 20*a* to be swung. This allows the cross bar carriers 4 connected via the link member 18 to the feed lever 20*a* to be displaced towards their upstream side. At the same time the lift means 3 are driven to raise the lift beams 2. Then, the cross bars 12 which have been held at a preset stand-by position Z that is an approximate midway point of the whole feed stroke of the transfer feeder as shown in FIG. 9A are allowed to be displaced along a pattern path as shown in FIG. 9A to a position above the workpiece where it is lowered. The work attracting means 13 attached to the cross bar 12 located at the most upstream side acts to attract the workpiece 14 having been transferred into the first work station W1 whereas the work attracting means 13 located at a site downstream of that side is allowed to attract a workpiece 14 having been press-formed in a succeeding work station W2, W3, . . . .

Thereafter, the lift means 3 raises the lift beams 2 causing the cross bars 12 to be raised as well, along the patterned path indicated in FIG. 9A. And, where the workpiece 14 attracted by the work attracting means 13 arrives at the vicinity of the path line P, the feed lever 20*a* being reciprocated causes the cross bar carrier 4 to be displaced in the feed (X-axis) direction to allow the cross bars 12 to commence an advancing.

During the cross bar's advancing operation, the control means acts to elongate (extend) the feed stroke changing means 7, for example, by 100 mm, to cause the subsidiary carrier $\mathbf{4}_2$ relative to the principal carrier $\mathbf{4}_1$ to move, by 100 mm, downstreams. Then, where the workpiece 14 arrives at a site above a succeeding work station W2, W3, . . . , the lift means 3 lowers the lift beams 2 so that the cross bars 12 may be lowered along the patterned path shown in FIG. 9A to transfer the workpiece 14 into the work station W2, W3, . . . .

Subsequently, when the work attracting means 13 releases the workpiece 14, the cross bars 12 commence returning. Then, a contraction (retraction) of the feed stroke changing means 7 by 100 mm causes the subsidiary carrier $\mathbf{4}_2$ relative to the principal carrier $\mathbf{4}_1$ to be displaced by 100 mm upstreams to return the cross bars 12 to the initial stand-by position Z and to bring it a halt there.

Thereafter, a repetition of the operation mentioned above in synchronism with the operation of the press machine body 1 causes the workpiece 14 transferred therein to be sequentially worked (formed) in the work stations W2, W3, . . . , in succession, permitting the workpiece 14 that has undergone all the working operations to be eventually transferred out of the press machine body 1.

It should be noted that the feed stroke is altered in the above mentioned example specifically by using as the feed stroke changing means 7 a cylinder assembly which is designed to extend (or expand or elongate) and retract (or contract), herein generally referred to simply as "deform". In the example described, it can be seen that any of various patterned paths other than that shown in FIG. 9A for the movement of the cross bar 12 may be alternatively employed.

Figure 9B:
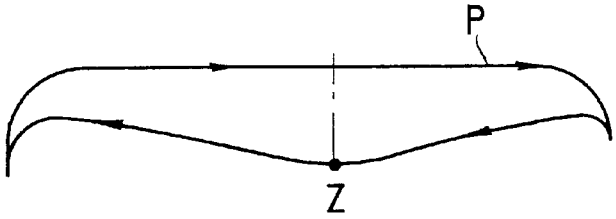
Figure 10A:
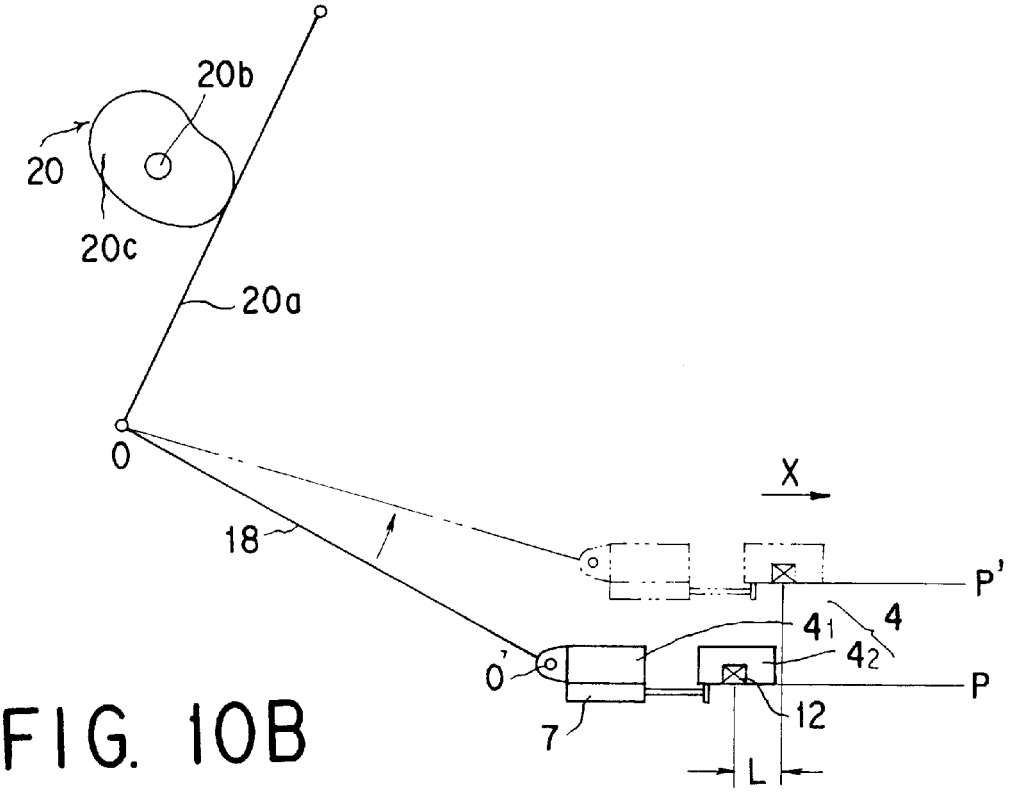
FIGS. 10A and 10B are each a functional explanatory view that illustrates a transfer press in which its path line is being changed.
Figure 10B:
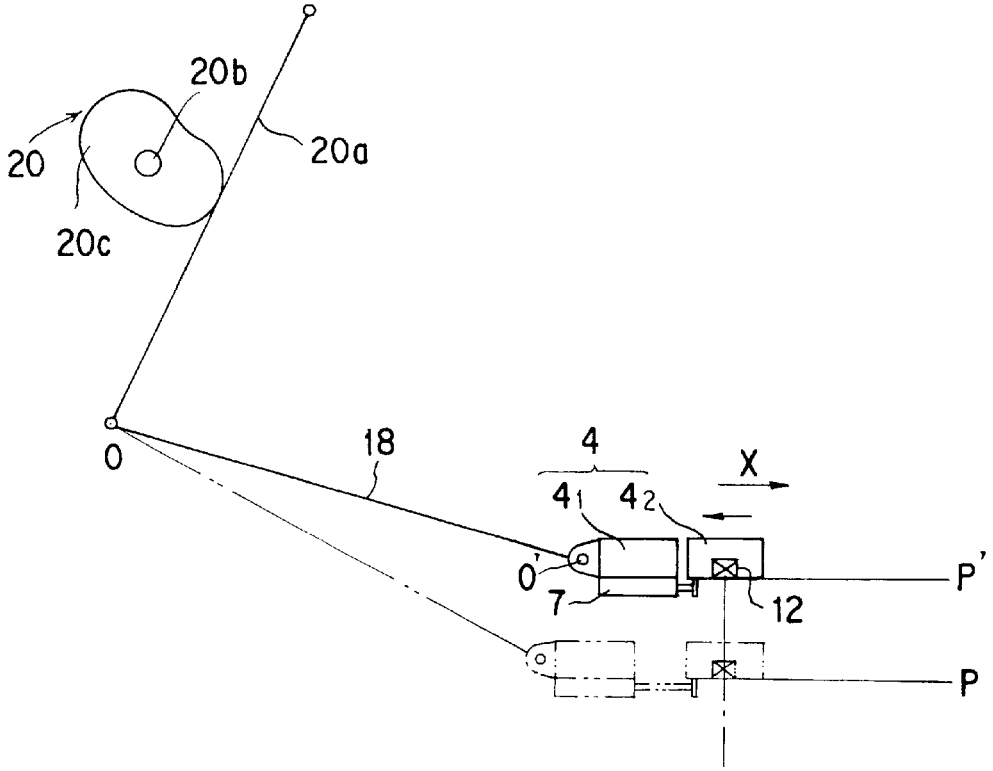

For example, a patterned path as indicated in FIG. 9B is obtained for the cross bar 12 by permitting the feed stroke changing means 7 to retract or contract by 100 mm when the cross bar 12 is returned from the stand-by position Z to the upstream and to extend or elongate by 100 mm in its advancing operation.

Figure 9C:
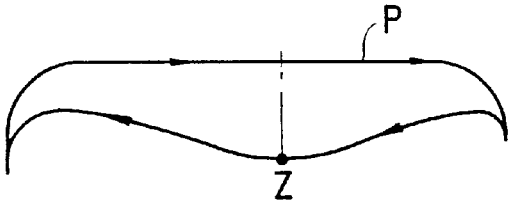

A pattern path as indicated in FIG. 9C is obtained for the cross bar 12 with the feed stroke changing means 7 allowed to retract or contract by 100 mm in the cross bar 12's advancing operation and to extend or elongate by 100 mm when it is returned from the downstream to the stand-by position Z.

Figure 9D:
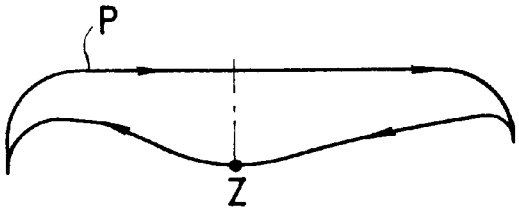

A patterned path as indicated in FIG. 9D is obtained for the cross bar 12 with the feed stroke changing means 7 caused to extend or elongate by 100 mm when the cross bar 12 is returning from the stand-by position Z to the upstream and to retract or contract by 100 mm when it is operated to advance.

This permits the workpiece 14 and the work attracting means 13 to be prevented from interfering with a die or a slide la while the workpiece 14 is being transferred. And, the feed stroke may be varied for each of the cross bars 12, then the transfer of workpieces 14 becomes still possible if the work stations are not equidistantly spaced apart.

Also, if the transfer press path line is varied from P to P' as shown in FIGS. 10A and 10B in accordance with a change in configuration of workpieces 14 or a change in height of dies used, the variation of the path line from P to P' can be effected while controlling the lift means 3 with the control means.

Then, raising the lift beams 2 and the cross bar carriers 4 by the lift means 3 allows the cross bars 12 to be raised.

Then, since the feed lever 20*a* remains at a halt, the point 0' at which the cross bar carrier 4 and the link member 18 are pivotally connected together assumes a circular motion in a vertical plane about the point 0 at which the feed lever 20*a* and the link member 18 are pivotally connected together so that as the lift beams 2 are raised the cross bar carrier 4 may be displaced downstreams. As a consequence, as shown in FIG. 10*a* an error L does develop in the feed (X-axis) direction at the cross bar 12 supported by the cross bar carrier 4 with the height difference between the path lines P and P'.

As pointed out earlier, the error L has heretofore caused a problem to rise such that the workpiece 14 is enable to be attracted at a predetermined site to a suction type work attracting means 13. Such a problem is effectively resolved according to the present invention by permitting the feed stroke changing means 7 to displace the subsidiary carrier $\mathbf{4}_2$ in the feed (X-axis) direction as the path line is changed from P to P' so as to eliminate the error L.

More specifically, the control means that has been described has stored therein a table of corrective values, determined by path lines (P, P', . . . ) which are different in height, with respect to the distance of the cross bar carrier 4 from the point of origin so that as the path line is changed from P to P', an input of the height the a path line after the change into the control means will cause the latter to read out of the table a particular corrective value in distance determined by the height input of the path line and to furnish the feed stroke changing means 7 with a control signal representing the corrective value.

This causes, as the path line is changed from P to P', the feed stroke changing means 7 to retract or contract as shown in FIG. 10B, permitting the subsidiary carrier $\mathbf{4}_2$ to be displaced upstreams by the error L to reduce it to 0, thereby effecting a compensation for the same.

Also, if the path line is changing from P' to P with a resultant shift upstream of the cross bar carrier 4 to develop the error L in the position of the cross bar 12 in the feed (X-axis) direction, a control signal furnished from the control means causes the feed stroke changing means 7 to extend or expand, permitting the subsidiary carrier $\mathbf{4}_2$ to be displaced downstreams so as to reduce the error L to 0, thus compensating for the same.

Figure 11:
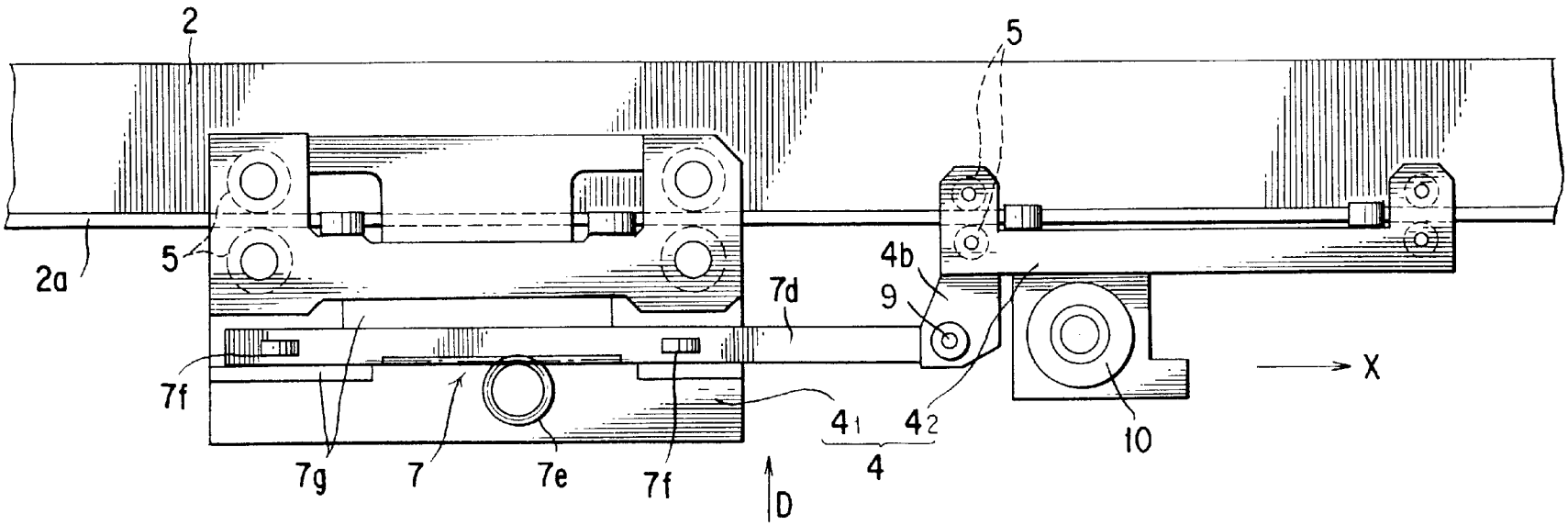
FIG. 11 is a front view that shows a cross bar carrier upon which a second embodiment of the feed stroke varying apparatus for a transfer feeder is practiced.
Figure 12:
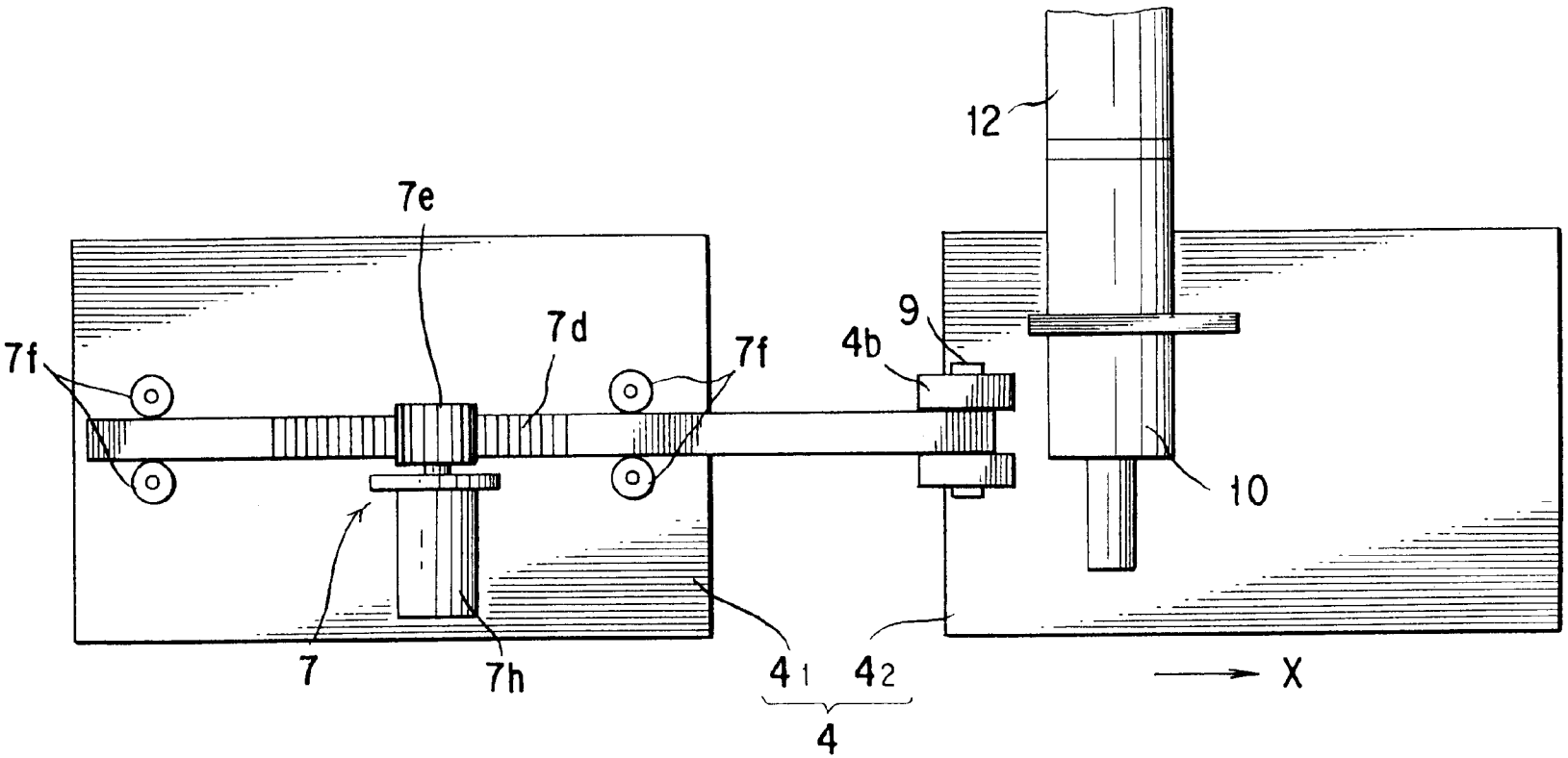
FIG. 12 is a side elevational view taken as viewed from the direction of the arrow D in FIG. 11.

FIGS. 11 and 12 illustrate a second embodiment of the present invention in which the feed stroke means 7 is constituted by a rack (7*d*) and pinion (7*e*) arrangement in lieu of the cylinder arrangement previous shown.

More specifically, a rack 7*d* extending in the feed (X-axis) direction is arranged on the principal carrier $\mathbf{4}_1$ and supported by rollers 7*f* and guide members 7*g* so as to be displaceable in the feed (X-axis) direction.

The downstream side of the rack 7*d* is connected via the pin 9 to the bracket 4*b* of the subsidiary carrier $\mathbf{4}_2$ and the principal carrier $\mathbf{4}_1$ is provided with a rotary drive source 7*h* which may be constituted by a servo motor. The rotary drive source 7*h* rotating a pinion 7*e* in mesh with the rack 7*d* causes the subsidiary carrier $\mathbf{4}_2$ to be displaced in the feed (X-axis) direction relative to the principal carrier $\mathbf{4}_1$ to allow the feed stroke to be altered.

It should be noted that analogously to the first embodiment the second embodiment employs an arrangement in which both principal and subsidiary carriers $\mathbf{4}_1$ and $\mathbf{4}_2$ are supported by lift beams 2, the cross bar 12 is carried by subsidiary carriers $\mathbf{4}_2$ and the workpiece 14 is operatively. transferred as previously shown and described. Also, in FIGS. 11 and 12 the same reference numerals as used in the previous figures are intended to show the same parts or components.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A feed stroke varying apparatus for a transfer feeder for use in a transfer press having a plurality of work stations in a press machine body, the transfer feeder having a plurality of cross bars arranged spaced apart from one another in a feed direction and operative to move two-dimensionally by a feed means and a lift means, and an attractive means carried by each of the cross bars for attractively holding a workpiece and movable therewith for transferring the workpiece into and from one of the work stations to another sequentially, the feed stroke varying apparatus comprising:

a pair of lift beams adapted to be raised and lowered by said lift means;

a plurality of cross bar carriers carried spaced apart from one another by said pair of lift beams in the feed direction and each constructed of a principal carrier and a subsidiary carrier both suspended from lower sides of said lift beams so as to be capable of reciprocating;

a coupling means for interconnecting the principal carriers;

a link member for connecting to said feed means one of said principal carriers which is located at a most upstream side thereof;

a feed stroke changing means arranged between a said principal carrier and a said subsidiary carrier for changing a relative distance therebetween to alter a stroke of feed performed by said cross bars; and a control means for controlling an operation of said feed stroke changing means, each of said cross bars being detachably bridged across a pair of said subsidiary carriers opposed to each other, said feed means being adapted to reciprocate said cross bars in the feed direction, said feed stroke changing means being adapted to alter the feed stroke of said cross bars.

2. A variable feed stroke feeder apparatus for a transfer feeder as set forth in claim 1, in which said control means is responsive to an error in feed stroke resultant from a change in transfer press path line as caused by a change in height of said cross bars and is operative to act to extend and retract said feed stroke changing means so as to correct said error.

* * * * *